US006972615B2

(12) United States Patent
Rashid

(10) Patent No.: US 6,972,615 B2
(45) Date of Patent: Dec. 6, 2005

(54) VOLTAGE REFERENCE GENERATOR

(75) Inventor: Tahir Rashid, Harrow (GB)

(73) Assignee: STMicroelectronics Limited, (GB)

( * ) Notice: Subject to any disclaimer, the term of this patent is extended or adjusted under 35 U.S.C. 154(b) by 0 days.

(21) Appl. No.: 10/620,834

(22) Filed: Jul. 15, 2003

(65) Prior Publication Data

US 2004/0119528 A1 Jun. 24, 2004

(30) Foreign Application Priority Data

Aug. 6, 2002 (EP) ..... 02255482

(51) Int. Cl.[7] ..... G05F 1/10; G05F 3/02
(52) U.S. Cl. ..... 327/538
(58) Field of Search ..... 327/538–541, 327/543; 323/312, 313, 315, 316

(56) References Cited

U.S. PATENT DOCUMENTS

| | | | | |
|---|---|---|---|---|
| 5,519,354 | A | 5/1996 | Audy | |
| 5,774,013 | A | 6/1998 | Gore | |
| 6,016,051 | A | 1/2000 | Can | |
| 6,323,630 | B1 * | 11/2001 | Banba | 323/313 |
| 6,366,071 | B1 | 4/2002 | Yu | |
| 6,605,995 | B2 * | 8/2003 | Toda | 330/252 |
| 2003/0076159 | A1 * | 4/2003 | Shor et al. | 327/541 |

* cited by examiner

*Primary Examiner*—Quan Tra
(74) *Attorney, Agent, or Firm*—Lisa K. Jorgenson; Graybeal Jackson Haley LLP

(57) ABSTRACT

The described embodiments of the invention relate to a voltage reference generator which can be produced using new process technologies and which is still compatible with older designs/products. This is achieved by the introduction of circuitry to generate an offset voltage independently of the main reference voltage generation circuitry.

5 Claims, 1 Drawing Sheet

VOLTAGE REFERENCE GENERATOR

PRIORITY CLAIM

This application claims priority from European patent application No. 02255482.8, filed Aug. 6, 2002, which is incorporated herein by reference.

TECHNICAL FIELD

The present invention relates generally to a voltage reference generator.

BACKGROUND

When designing circuits for generating voltage references using modern high speed processes, it is often the case that the optimal or natural value for the reference voltage (Vref) is lower than the optimal value of the reference voltage in designs using older processes. In particular, the value of the voltage generated in the design of an industry standard 431 type reference generator is based around the base emitter voltage Vbe of a bipolar transistor. In circuits manufactured using more up to date process technology, this Vbe is generally lower than older process technology, so that the same circuit design generates a lower reference voltage.

This poses a problem when there is a requirement to produce a reference voltage which is compatible with older designs/products: the new process technology would typically produce a reference voltage that was a little too low for the older design. Similarly, a difficulty arises when an older product needs to be transferred to newer process technology.

The "correction" required is often only in the region of a few tens of mV, but should preferably be nearly constant with temperature so as not to degrade the performance of the circuit using the reference voltage, or the reference itself as this is ideally constant in temperature.

A known design to produce a variable voltage reference is shown in the circuit of FIG. 1. The circuit comprises a bipolar transistor TR1 having its collector connected to a supply voltage rail VDD, its base connected to an input node 4 and its emitter connected via a resistor chain to the lower supply rail GND. The resistor chain comprises three resistors RA, RB and RC. A VPTAT (voltage proportional to absolute temperature) generator 6 is connected to supply a voltage that is proportional to absolute temperature across the middle resistor, RB. That voltage may typically be 60 mV at room temperature. This voltage sets the current I through the resistive chain RA, RB, RC. The values of the resistors RA, RB and RC are selected so that the total voltage $V_{tot}$ across the resistor chain is roughly equal to the base emitter voltage Vbe of the transistor TR1, that is around 0.62 V. Since the base emitter voltage of the transistor TR1 has a negative temperature coefficient and the voltage $V_{tot}$ across the resistive chain has a positive temperature coefficient, the net effect is a reference voltage Vref, taken at the input node 4, which is very stable with temperature.

A circuit of the form illustrated in FIG. 1 is used in many products such as an industry standard 431 type voltage reference generator, and has a voltage reference value Vref of 1.24 V. If that circuit were to be produced using modern process technology, the reference voltage could fall to 1.20 V. This is mainly because the base emitter voltage of the NPN transistor TR1 is lower using modern process technology, for example around 0.6 V. Therefore the optimal selection of the resistor values RA, RB, RC to maintain temperature stability of the reference voltage sets $V_{tot}$ at around 0.6 V.

SUMMARY

According to one aspect of the present invention, there is provided a voltage reference generator circuit for generating a reference voltage of a predetermined value comprising: first circuitry adapted to generate a first voltage which is substantially independent of temperature and related to a component parameter susceptible to variations with process technology; second circuitry adapted to generate an offset voltage of a value such that the sum of the first voltage and the offset voltage is said predetermined value, and wherein the second circuitry comprises components whose parameters are variably selectable without affecting the first voltage.

In the described embodiment, the first circuitry comprises a bipolar transistor, the base emitter voltage of which is susceptible to variations with process technology. Therefore, the first voltage varies with process technology. The offset voltage can be set to provide the required reference voltage depending on the value of the first voltage according to the process technology which is being used.

Another aspect of the invention provides a voltage reference generator circuit comprising: a first bipolar transistor connected in series with a resistive chain between upper and lower supply rails and having an input node at its base; a current generating circuit connected to supply a current to a node of said resistive chain, said resistive chain including a compensation resistor connected between said node and said lower supply rail; voltage generating means for generating a voltage proportional to absolute temperature across a current setting resistor of said resistive chain; wherein the resistive value of the compensation resistor is selectable independently of the values of other components in the resistive chain, whereby an offset voltage across said compensation resistor is independently settable.

BRIEF DESCRIPTION OF THE DRAWINGS

For a better understanding of the present invention and to show how the same may be carried into effect, reference will now be made by way of example to the accompanying drawings, in which.

DETAILED DESCRIPTION

The following discussion is presented to enable a person skilled in the art to make and use the invention. Various modifications to the embodiments will be readily apparent to those skilled in the art, and the generic principles herein may be applied to other embodiments and applications without departing from the spirit and scope of the present invention. Thus, the present invention is not intended to be limited to the embodiments shown, but is to be accorded the widest scope consistent with the principles and features disclosed herein.

Figure 1:
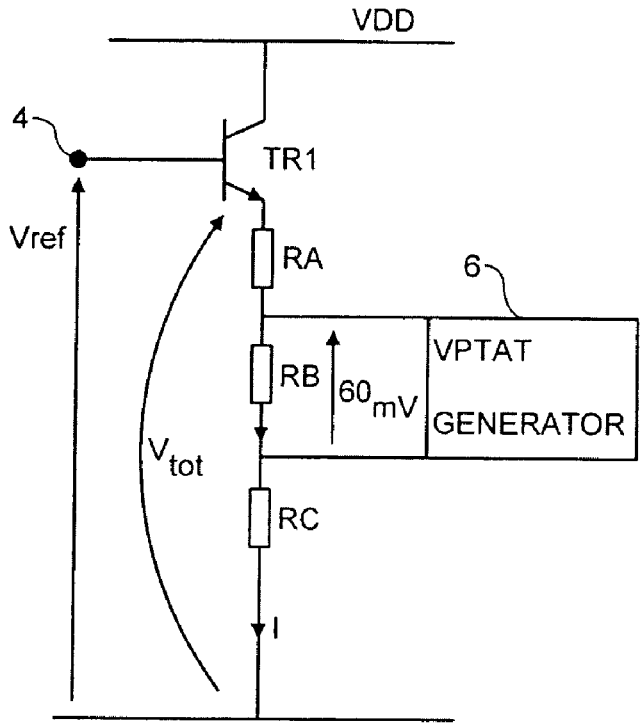
FIG. 1 is a schematic diagram of a known voltage reference generator.
Figure 2:
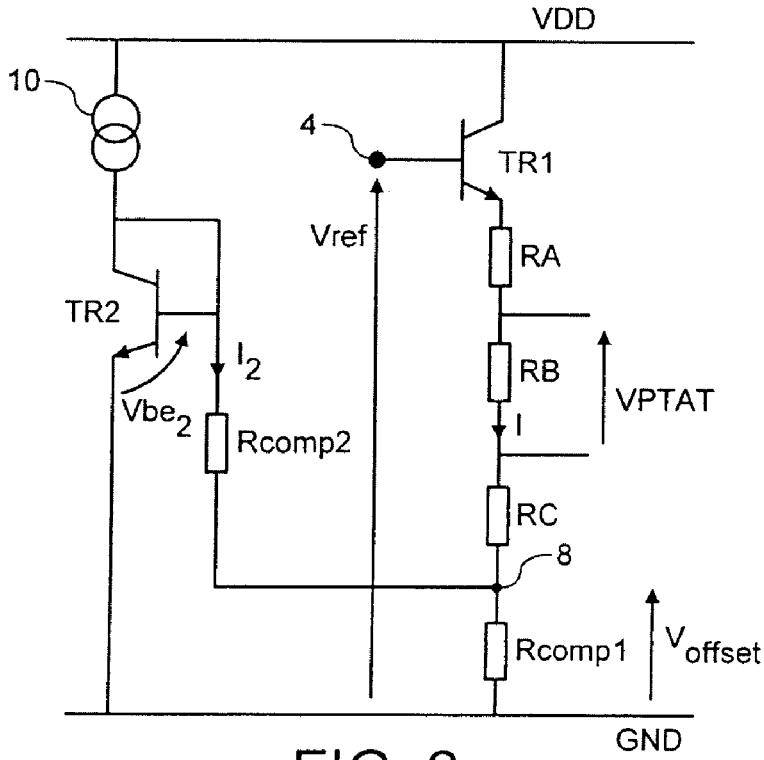
FIG. 2 is a schematic diagram of a voltage reference generator in accordance with one embodiment of the invention.

In FIG. 2, like parts are denoted with like designators as in FIG. 1. In particular, the circuit of FIG. 2 includes the bipolar transistor TR1 connected to the resistive chain RA, RB, RC. The VPTAT generator circuit 6 is not shown in FIG. 2 but exists to generate the voltage proportional to absolute temperature in the same manner as explained with reference to FIG. 1.

The resistive chain RA, RB, RC terminates in a node 8 which is connected to the lower supply rail GND via a first compensation resistor Rcomp1. A second compensation resistor Rcomp2 is connected between the node 8, the base and collector of a second bipolar transistor TR2 and one side of a current source 10. The other side of the current source 10 is connected to the upper supply rail VDD.

The emitter of the second bipolar transistor TR2 is connected to the lower supply rail GND. The reference voltage Vref is taken between the input node 4 and the lower supply rail GND. The idea underlying the circuit of FIG. 2 is that the value of the resistors RA, RB and RC are selected so that the voltage across them is roughly equal to the base emitter voltage Vbe of the transistor TR1. This provides a voltage which is relatively stable with temperature but, it will be recalled, is therefore somewhat set by the base emitter voltage Vbe of the first transistor TR1. When using modern process technology, this is lower than with older process technologies, and may be of the order of 0.6 V. To take account of this, an offset voltage is generated across the first compensation resistor Rcomp1. Thus, the reference voltage Vref is given as follows:

$$Vref=Vbe+V(RA+RB+RC)+V_{offset} \quad \text{(Equation 1)}$$

The offset voltage $V_{offset}$ is generated as follows. The current source 10 biases the second bipolar transistor TR2. This produces a current through the second compensation resistor Rcomp2 which is proportional to the base emitter voltage $Vbe_2$ of the second bipolar transistor TR2. The current through the first compensation transistor Rcomp1 is the sum of the current through the second compensation resistor Rcomp2 and the current I through the current setting resistor RB and thus through the resistive chain as a result of the voltage proportional to absolute temperature generated across the resistor RB. By suitable selection of the values of the compensation resistors Rcomp1 and Rcomp2, the offset voltage $V_{offset}$ can be set at the absolute value required to correct the overall reference voltage generated by the circuit. In addition, the offset voltage is independent of temperature because the slight decrease with temperature exhibited by the effect of the second transistor TR2 on the current $I_2$ through Rcomp2 is offset by the increase in I with temperature. The currents I and $I_2$ are roughly of the same magnitude in one embodiment of the present invention.

The embodiment of the voltage generator described above with reference to FIG. 2 may be incorporated into an integrated circuit such as a memory device, which may, in turn, be incorporated into an electronic system such as a computer system.

From the foregoing it will be appreciated that, although specific embodiments of the invention have been described herein for purposes of illustration, various modifications may be made without deviating from the spirit and scope of the invention.

What is claimed is:

1. A voltage reference generator circuit comprising:

a first bipolar transistor connected in series with a resistive chain between upper and lower supply rails and having an input node at its base;

a current generating circuit connected to supply a current to a node of said resistive chain, said resistive chain including a compensation resistor connected between said node and said lower supply rail;

voltage generating means for generating a voltage proportional to absolute temperature across a current setting resistor of said resistive chain;

wherein the resistive value of the compensation resistor is selectable independently of the values of other components in the resistive chain, whereby an offset voltage across said compensation resistor is independently settable.

2. A voltage reference generator circuit according to claim 1, wherein the current generated by the current generating circuit is supplied through first and second compensation resistors.

3. A voltage generator, comprising:

an offset circuit operable to develop an offset voltage and operable to adjust the offset value as a function of temperature;

a voltage generation circuit coupled to the offset circuit, the voltage generation circuit operable to develop a first reference voltage and adjust the value of the first reference voltage as a function of temperature, and operable to provide an output reference voltage equal to the first reference voltage plus the offset voltage;

wherein the voltage generation circuit includes, a bipolar transistor having a base-emitter voltage that is a function of temperature;

the offset circuit includes a bipolar transistor having a base-emitter voltage that is a function of temperature; and wherein the voltage generation circuit includes, a resistor network coupled between an emitter of the bipolar transistor and a node;

the offset circuit comprises a resistive element having a first terminal coupled to the node and a second terminal adapted to receive a reference voltage; and wherein the offset circuit further comprises:

a current source having a first terminal adapted to receive a supply voltage and a second terminal; and a resistive element having a first terminal coupled to a base of the bipolar transistor and a second terminal coupled to the node; and wherein a collector and the base of the bipolar transistor are coupled to the second terminal of the current source and an emitter of the bipolar transistor is adapted to receive a reference voltage.

4. An integrated circuit, comprising:

a voltage generator, comprising, an offset circuit operable to develop an offset voltage and operable to adjust the offset value as a function of temperature, wherein the offset circuit includes a bipolar transistor having a base-emitter voltage that is a function of temperature, and a voltage generation circuit coupled to the offset circuit, the voltage generation circuit operable to develop a first reference voltage and adjust the value of the first reference voltage as a function of temperature, and operable to provide an output reference voltage equal to the first reference voltage plus the offset voltage, wherein the voltage generation circuit includes a bipolar transistor having a base-emitter voltage that is a function of temperature;

wherein the voltage generation circuit includes, a first bipolar transistor connected in series with a resistive chain between upper and lower supply rails and having an input node at its base;

voltage generating means for generating a voltage proportional to absolute temperature across a current setting resistor of said resistive chain; and wherein the offset circuit includes, a current generating circuit connected to supply a current to a node of said resistive chain, said resistive chain including a compensation resistor connected between said node and said lower supply rail; and wherein the resistive value of the compensation resistor is selectable independently of the values of other components in the resistive chain, whereby an offset voltage across said compensation resistor is independently settable.

5. The integrated circuit of claim 4 wherein the integrated circuit comprises a memory device.

* * * * *